United States Patent [19]

Thomann et al.

[11] Patent Number: 4,553,874

[45] Date of Patent: Nov. 19, 1985

[54] SLOTTED DRAINAGE GRATE WITH SUPPORT

[75] Inventors: Roland Thomann; Markus Amann, both of Langnau, Switzerland

[73] Assignee: Polydrain, Inc., Troutman, N.C.

[21] Appl. No.: 679,184

[22] Filed: Dec. 7, 1984

Related U.S. Application Data

[63] Continuation of Ser. No. 506,244, Jun. 20, 1983, Pat. No. 4,515,498.

[30] Foreign Application Priority Data

Nov. 23, 1982 [CH] Switzerland ..... 6827/82

[51] Int. Cl.[4] ..... E01F 5/00

[52] U.S. Cl. ..... 404/4; 210/164; 52/169.5; 52/662

[58] Field of Search ..... 404/2–5, 404/25, 26; 52/19–21, 169.5, 180, 660, 662; 210/163–166; 405/43

[56] References Cited

U.S. PATENT DOCUMENTS

| | | | |
|---|---|---|---|
| 1,396,442 | 11/1921 | Lachman | 52/662 |
| 1,494,823 | 5/1924 | Tappen | 52/660 X |
| 3,672,111 | 6/1972 | Deck et al. | 52/180 X |
| 4,267,954 | 5/1981 | Smith | 52/180 X |
| 4,367,142 | 1/1983 | Blecher | 404/2 X |

*Primary Examiner*—Stephen J. Novosad
*Assistant Examiner*—Beverly E. Hjorth
*Attorney, Agent, or Firm*—W. Thad Adams, III

[57] ABSTRACT

A slotted grate (3) is disclosed which is formed of a sheet metal strip with slot (15) therein. Reinforcement of the grate (3) is achieved by inserting a sheet metal arch support (30) between two adjacent slots (15). The arch support (30) is formed of a piece of sheet metal bent into a U-shape with shoulders (35, 36) of its end sections (31) being spaced further apart than the shoulders (37, 38) of its midsection (32). A process is disclosed wherein the slotted grate (3) is constructed by first placing arch supports (30) between the desired slots (15) and then double bending the edge sections of the sheet material forming the grate (3) to form two U-shaped side channels with the shoulders (35, 36) of arch support (30) locked securely therein.

4 Claims, 6 Drawing Figures

FIG. 1
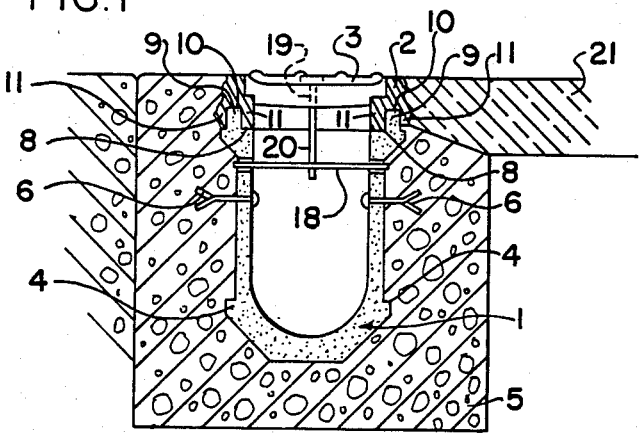
FIG. 2
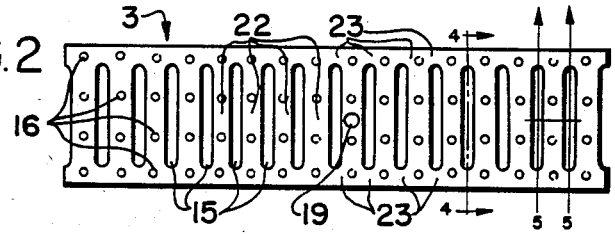
FIG. 3
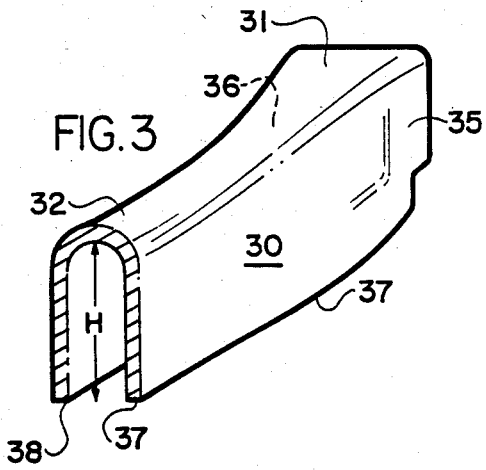
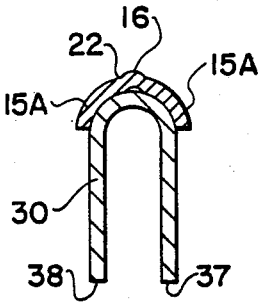
FIG. 5

SLOTTED DRAINAGE GRATE WITH SUPPORT

This is a continuation of application Ser. No. 506,244 filed June 20, 1983, now U.S. Pat. No. 4,515,498.

TECHNICAL FIELD AND BACKGROUND OF THE INVENTION

This invention relates to a support for a drainage grate of the type comprised of a strip of sheet metal having transverse water drainage slots formed therein. The grates are manufactured in pre-determined lengths and are intended to fit within pre-formed, cast drainage channels. Also disclosed in this application is a support for use with a drainage grate and a process of constructing the slotted drainage grate according to the present invention.

Slotted grates of the general type described in this application are specifically designed to cover relatively narrow drainage channels on or along, for example, roadways or airport runways in order to permit free drainage of water but still provide an uninterrupted relatively level surface free of dangerous depression and holes. In the embodiment shown in this application, the grate is intended to specifically be used as a cover for channels to render the grate safe for use in heavy load/stress environments such as where vehicles will be passing over the grate.

A grating has been marketed under the designation "Aco" which provides the needed additional reinforcement by placing the grate bridge between the slots by means of a second grate. This second grate consists of supports added between the edge tracks which form one unit with the edge tracks. These supports are bent to form a U-shape in the shoulder width corresponding to the division of two slots each. The disadvantage of this type of arrangement is that only every second or third grate bridge can be supported. This is because in order to achieve a certain shoulder width which is greater than the width of the slot flaring, it is necessary to use the material from the width of the adjacent slots. This means that any increases in reinforcement necessitate the use of a heavier guage material.

A further disadvantage occurs in the manufacturing process as the material is bent to form side channels. As it happens, the side tracks cannot provide adequate support to form the edges.

SUMMARY OF THE INVENTION

Therefore, it is an object of the invention to provide a support for slotted drainage grate having a support to provide additional strength to the grate, and a process for constructing a slotted grate.

It is another object of the present invention to provide a slotted drainage grate which provides support to the width of the grate and to each side of the grate.

It is yet another object of the present invention to provide a support for a slotted drainage grate wherein the support is positioned in contact with the underside of the grate and has a top, mating surface corresponding to the shape of the underside of the grate so as to provide support along its entire width.

It is yet another object of the present invention to provide a drainage grate wherein the support is locked within the grate so it cannot be removed.

These and other objects and advantages of the present invention are achieved in the preferred embodiment of the product and process described below by providing a slotted grate having increased resistance to flexure and comprising a strip of sheet metal, the edges of which are bent twice along its longitudinally extending edges to form two U-shaped side channels with open sides mutually opposed. Each side channel defines a first shoulder having a free end adapted to support a side wall section of a drainage channel into which the grate is positioned, and a second shoulder defining the longitudinally extending dimension of the grate. The surface of the grate intermediate the two side channels defines a plurality of transverse slots extending along its length for the passage of drainage water therethrough into a drainage channel onto which the grate is adapted to be positioned.

The grate includes a support comprising a U-shaped arch open on each end and adapted to be positioned transversely across the grate in contact with the underside thereof intermediate at least some of the slots to provide support to the width of the grate. Each end of the support defines a shoulder having width and depth sufficient to be positioned in and provide support to the two U-shaped mutually opposed side channels.

According to one embodiment of the invention, the midsection of the arch of the support is arcuate and the opposing end sections of the arch are planar. The support is therefore adapted to cooperate with a grate having a mating arcuate surface between each slot and planar side channels.

Also, the end sections of the support are flared apart to each define an arch having a width greater than that of the midsection of the support.

In accordance with the process of constructing the grate according to the present invention, a plurality of transverse, longitudinally extending slots is formed in a strip of sheet material. A support according to the present invention is inserted between two of the slots and the edge sections of the sheet material are double bent around the end sections of the support to form two U-shaped side channels with the shoulders of the support locked securely therein.

BRIEF DESCRIPTION OF THE DRAWINGS

Some of the objects of the invention have been set forth above. Other objects and advantages of the invention will appear as the description of the invention proceeds, when taken in conjunction with the following drawings, in which:

FIG. 1 is an overall cross-sectional view of a slotted grate with support according to the present invention positioned in a drainage channel;

FIG. 2 is a top view of a slotted grate;

FIG. 3 is a perspective view of a support (cut in two at its approximate midsection) according to the present invention;

FIG. 5 is a cross-sectional view of a section intermediate two slots and the support positioned beneath it taken substantially along lines 5/5 of FIG. 2.

DESCRIPTION OF THE PREFERRED EMBODIMENT

Figure 4:
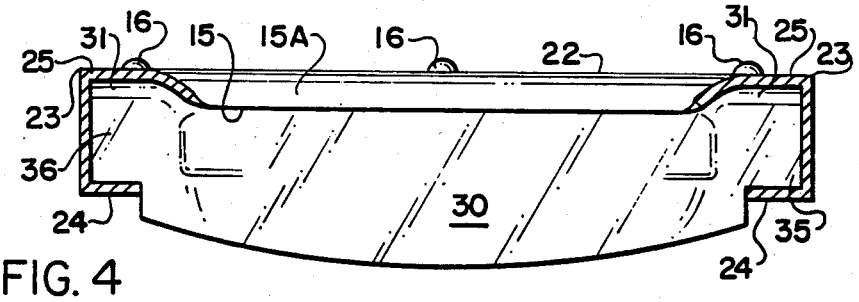
FIG. 4 is a cross-sectional view of the full length of a support according to the present invention taken substantially along lines 4/4 of FIG. 2.
Figure 6:
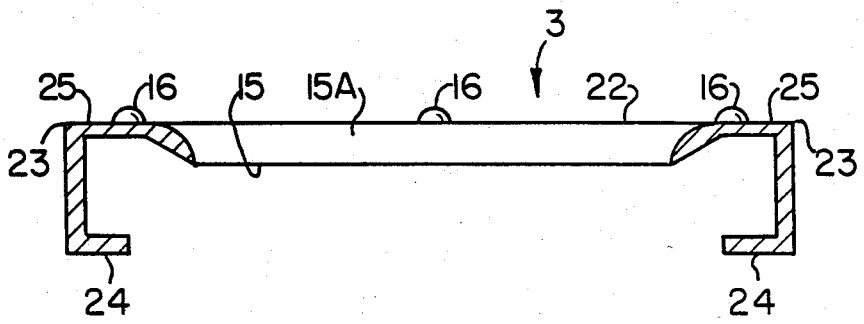
FIG. 6 is a cross-sectional view of the grate, including the double bent, U-shaped side channels.

Referring now specifically to the drawings, FIG. 1 illustrates in cross-section a drainage channel of a general type with which the invention according to this application may be used. The channel comprises a drainage channel body 1 upon which a cast frame 2 is set. The cast frame 2 in turn supports a channel grate 3. The channel body 1 may preferably be manufactured of polyester concrete and is provided with protusions 4 on each side to firmly anchor the drainage channel within its foundation. Additional anchoring is provided by a pair of anchors 6. The upper edges of channel body 1 are provided with mounting surfaces 8 to accommodate the frame 2 and feature parallel tracks 9 which engage in corresponding longitudinal slots 10 within frame 2. Guide tabs 11 along the longitudinally extending slots hold the frame 2 firmly in place and intermesh with pavement 21. To prevent frame 2 from ripping from the concrete foundation 5, a suitable angle is provided.

The slotted grate 3 is placed on top of channel body 1. Grate 3 is anchored in place using a screw 20 which is inserted into a countersunk hole 19 and screwed into a metal locking strap 18.

In the case of this type of slide grate 3, it has been shown that in order to improve its capacity while continuing to use the same guage sheet metal, additional holes with flared edges must be provided. These openings are in addition to the flared slots 15, whose purpose is water drainage. While this may well affect a localized reinforcement, no doubt the overall strength of the grate will be diminished by the additional perforations.

The slotted grate 3 shown in FIGS. 1 and 2 features the slots 15 referred to above which are arranged symetrically with reference to the mid-longitudinal axis of a strip of sheet metal and perpendicular (transverse) to this axis, and which in addition are flared downwardly to define flared surfaces 15*a*. Located on the upper side of the slotted grate 3 in grate bridges 22 and in edge sections 23 are deflection bumps 16 whose purpose is to prevent sheet flow of water in the standard fashion.

FIG. 4 shows a cross-sectional view of grate 3 through a slot 15 together with the flared surfaces 15*a*, the grate bridges 22 and the edge sections 23 of grate 3, together with the deflection bumps 16. Located in the concave arch of the grate bridge 22 is a sheet metal arch support 30 for reinforcing the capacity of the slotted grate 3 as shown in FIG. 5.

The sheet metal arch support 30, as shown in FIGS. 3 and 4, consists of a section of sheet metal bent into a U-shape and whose end sections 31 are wider than its midsection 32. This is done in order to provide shoulders 35, 36 on the end sections 31 which are spaced further apart than shoulders 37 and 38 of the midsection 32.

Preferably, the distance apart of the shoulders 35 and 36 is at least approximately equal to that of the center-to-center distance of two adjacent slots 15. This permits reinforcement of channel shoulders 24, 25 which is beneficial during manufacture of the slotted grate 3 since the sheet metal can be bent around the shoulders 35, 36 to form the end channels of grate 3.

It is apparent that the strength of grate 3 can be increased as needed by inserting arch supports 30 into every second or third arch support bridge 22. In extreme situations, arch supports 30 can be inserted into every arch support bridge 22. In addition, the height (H) of shoulders 37 and 38 can be varied for the midsection and can be adapted to the particular strength requirements with the result that the cost/benefit ratio can be individually taylored. This economization can also include the selection of the guage of the sheet metal to be used.

According to the process of practicing the present invention, the plurality of transverse, longitudinally extending slots 15 is first formed in the sheet metal forming the grate 3. A support 30 according to the present invention is inserted between two of the slots 15 and is positioned in the concave arch of the grate bridge 22 which separates each slot 15. Then the edge sections of the sheet material forming the grate 3 are double bent around the end sections 31 of the support 30 to form the two side channels which define channel shoulders 24 and 25. The support 30 is therefore locked securely into position.

A slotted grate having a support and a process for manufacturing the slotted grate is described above. Various details of the invention may be changed without departing from its scope. Furthermore, the foregoing description of a preferred embodiment of the process and product according to the present invention is provided for the purpose of illustration only and not for the purpose of limitation—the invention being defined by the claims.

I claim:

1. A support for a grate of the type comprised of a strip of sheet metal having transverse water drainage slots therein, the edges of said sheet metal being bent twice along its longitudinally extending edges to form two U-shaped side channels whose open sides are mutually opposed, said support comprising:

(a) a U-shaped arch having a midsection intermediate opposing end sections, said arch being open on each end and adapted to be positioned transversely across said grate in contact with opposite sides thereof and intermediate at least some of the slots to provide support to the width of the grate, the midsection of said arch being arcuate and the opposing end sections being planar, said support being adapted to cooperate with a grate having a mating arcuate surface between each slot for receiving the midsection of said support and wherein the side channels of said grate are planar for matingly receiving the planar end sections of said support; and (b) each end of said arch defining a shoulder having a width and depth sufficient to be positioned in said opposing side channels and provide support to the side of said grate, the opposing end sections of said support being flared apart to each define an arch having a width greater than that of the midsection of said support.

2. A slotted grate having increased resistance to flexure, and comprising:

(a) a strip of sheet material, the edges of which are bent twice along its longitudinally extending edges to form two U-shaped side channels whose open sides are mutually opposed, each said side channel defining a first shoulder having a free end and adapted to support a side wall section of a drainage channel into which the grate is positioned and a second shoulder defining the longitudinally extending dimension of said grate, the surface of the grate intermediate the two side channels defining a plurality of transverse slots therein along the length thereof for the passage of drainage water therethrough into a drainage channel onto which the grate is adapted to be positioned, the combination therewith of a support for said grate comprising:

(b) a U-shaped arch open on each end and adapted to be positioned transversely across said grate in contact with the underside thereof intermediate at least some of the slots to provide support to the width of said grate;

(c) each end of said support defining a shoulder having a width and depth sufficient to be positioned in and provide support to the two U-shaped mutually opposed side channels, flared apart to each define an arch having a width greater than that of the midsection of said support.

3. A drainage channel and grate assembly comprising:

(a) a drainage channel comprising at least one elongate section having inner and outer walls, the inner walls defining a U-shaped, upwardly opening mouth for the passage of drainage water thereinto;

(b) a slotted grate for being positioned in said drainage channel for providing a bearing surface over said drainage channel while allowing liquid to drain through said slotted grate, said slotted grate including a strip of sheet material, the edges of which are bent twice along its longitudinally extending edges to form two U-shaped side channels whose open sides are mutually opposed, each said side channel defining a first shoulder having a free end and adapted to support a side wall section of a drainage channel into which the grate is positioned and a second shoulder defining the longitudinally extending dimension of said grate, the surface of the grate intermediate the two side channels defining a plurality of transverse slots therein along the length thereof for the passage of a drainage water therethrough into said drainage channel;

(c) a U-shaped arch open on each end and adapted to be positioned transversely across said grate in contact with the underside thereof intermediate at least some of the slots to provide support to the width of said grate; and (d) each end of said support defining a shoulder having a width and depth sufficient to be positioned in and provide support to the two U-shaped mutually opposed side channels and being flared apart to each define an arch having a width greater than that of the midsection of said support.

4. A drainage channel and grate assembly according to claim 3, wherein said supports are positioned transversely across said grate intermediate alternate slots.

* * * * *